US007398857B2

(12) United States Patent
Olivas

(10) Patent No.: US 7,398,857 B2
(45) Date of Patent: Jul. 15, 2008

(54) HOLDING TANK DRAIN PLUG

(76) Inventor: Hector Olivas, 12102 Aqueduct Rd., Houston, TX (US) 77044

( * ) Notice: Subject to any disclaimer, the term of this patent is extended or adjusted under 35 U.S.C. 154(b) by 694 days.

(21) Appl. No.: 10/828,808

(22) Filed: Apr. 21, 2004

(65) Prior Publication Data

US 2005/0236229 A1 Oct. 27, 2005

(51) Int. Cl.
*F16C 3/14* (2006.01)
*F16N 33/00* (2006.01)

(52) U.S. Cl. ..... 184/1.5; 215/357

(58) Field of Classification Search ..... 184/1.5, 184/106, 88.1, 92; 215/355–357; 220/296, 220/787, 789, 800, 801; 251/144, 346, 351
See application file for complete search history.

(56) References Cited

U.S. PATENT DOCUMENTS 2,509,426 A * 5/1950 Fransen ..... 137/353
3,836,117 A * 9/1974 Panicali ..... 251/351
4,470,577 A * 9/1984 Warwick ..... 251/217
5,368,181 A * 11/1994 Myers ..... 220/303
6,443,427 B2 * 9/2002 Coupal ..... 251/351

* cited by examiner

*Primary Examiner*—Richard W L Ridley
*Assistant Examiner*—James Pilkington
(74) *Attorney, Agent, or Firm*—Delphine James

(57) ABSTRACT

The present invention is an apparatus for draining fluid from a holding tank. The apparatus further comprises a first portion having an axial bore extending therethrough, the axial bore being defined by an upper end and a lower end. An outer wall surrounds the axial bore extending from the lower end to the upper end. The upper end is adapted to engage an existing drain of the holding tank such that fluid communication is established between the axial bore and the holding tank. At least one notch is formed within the outer wall of the bore. A second portion has a plate member with a plurality of leg members. The lower end of the bore being is permanently affixed to the plate member. A reservoir surrounds the leg members. The reservoir has a base portion with an external wall extending upward therefrom to surround the leg members. Each leg member extends downward into the base portion and being permanently affixed thereto. The base portion has an aperture for providing an outlet for drainage of the fluid from the holding tank.

11 Claims, 6 Drawing Sheets

HOLDING TANK DRAIN PLUG

BACKGROUND

The present invention relates to draining fluid from holding tanks for internal combustion engines. More specifically, it relates to drain plugs for fluid holding tanks. The unique drain plug of the present invention could be applied to all types of tanks where it is required to periodically drain fluid from a holding tank.

The maintenance of various vehicles requires the regular changing of engine fluid such as oil. Normally, a person wishing to change oil within an automobile must get underneath the automobile and completely loosening the oil plug from the holding tank. When the plug is removed, oil starts flowing uncontrollably creating an oil spill which is an environmental hazard. Additionally, skin contact with oil can have the potential of causing skin cancer. The present invention provides an improved drain plug that can alleviate this problem.

During a search, U.S. Pat. No. 5,411,115 an improved oil drain plug having a push and twist type of engagement was found. Also found was U.S. Pat. Nos. 5,727,652 and 5,975,157 which are also of the types of oil draining devices. However, none of the above patents disclosed above, taken singly or in combination describe the present invention.

SUMMARY

The present invention is an improved drain plug for a fluid tank such as an oil tank of a vehicle. The drain plug further comprises a first portion having an axial bore with its outer portion adapted to engage the drain of a tank. The bottom of the bore is securely mounted upon a plate member having a plurality of leg members. Each leg member extends downward into the base portion of a reservoir. The reservoir exterior wall extends upward surrounding the leg members. The present invention further includes a plurality of notches within the outer wall of the axial bore forming an opening therein. When the bore is released from the tank, the fluid flows through the notches into a single drain hole in the base portion of the reservoir. Controlling the fluid flow through the notches helps prevent the fluid contained in the tank from contacting the skin of the person releasing the drain plug from the tank, for example, a person performing an oil change. Thus, the main advantage of the present invention is the prevention of a health and environmental hazard.

BRIEF DESCRIPTION OF DRAWINGS

Various other features of the present invention will be better understood when considered in conjunction with the accompanying drawings.

DETAILED SPECIFICATION

Figure 1:
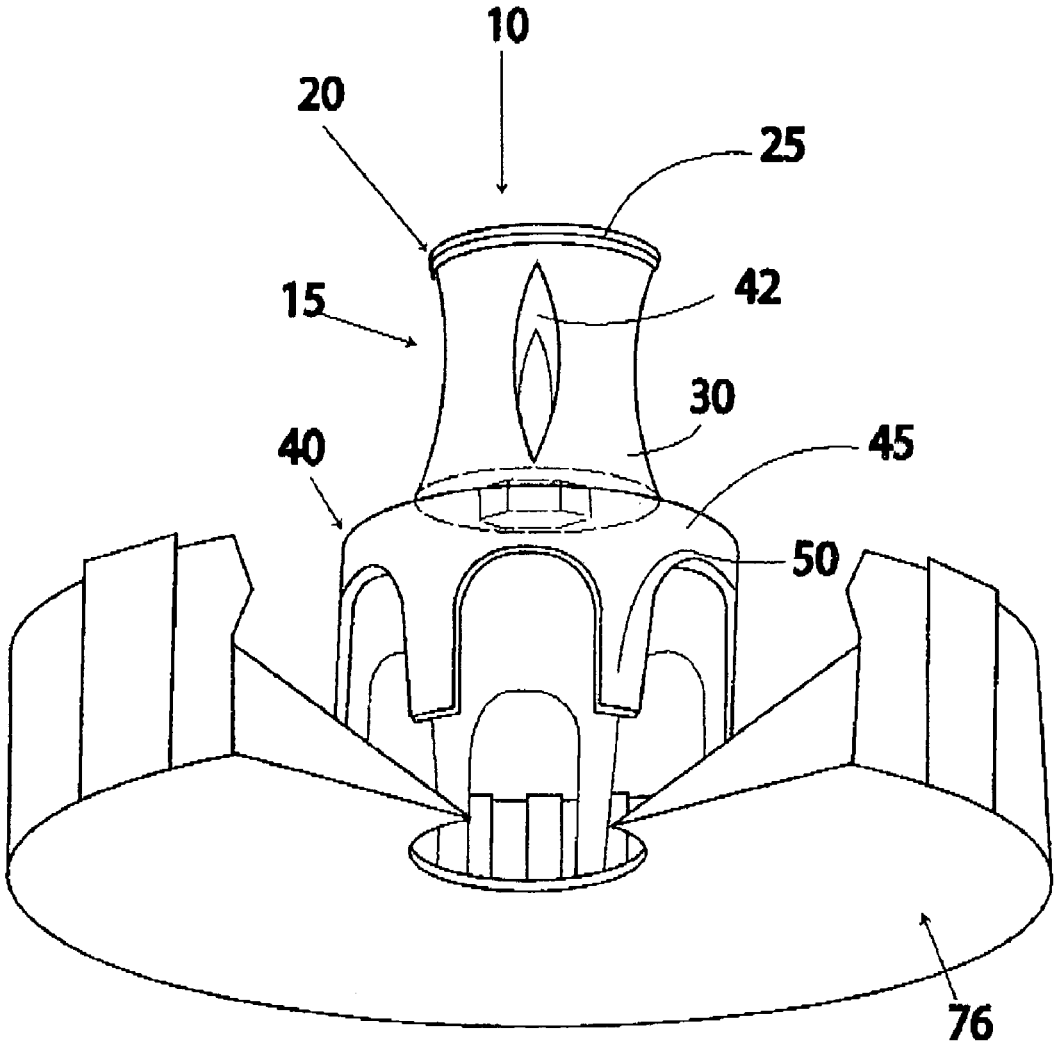
FIG. 1 is an overall perspective view of the present invention.

Referring to FIG. 1, there is shown an overall perspective view of one embodiment of the present invention, a device (10) for draining a fluid tank. The device (10) further includes a first portion (15) configured to engage the drain of a fluid tank (not shown). The fluid tank can be an oil tank of a vehicle. In the illustrated embodiment, first portion (15) is cylindrical. Device (10) can be manufactured from steel or another suitable material.

First portion (15) further includes axial bore (20) that is defined by an upper end (25) and a lower end (30). An outer wall extends upward from the lower end (30) to upper end (25). Additionally, the outer wall of the upper end (25) is configured and sized to engage the drain of a vehicle such that fluid communication is established between the axial bore and the fluid tank. As shown, upper end (25) is threaded to engage the drain of the tank. Within the outer wall is a plurality of notches (40) forming an opening therein. Each notch has a predetermined length and width to obtain the desired flow of fluid from the tank. Additionally, the wider and longer each notch the greater the flow of fluid from the tank. The notch can have an oval, eclipse, rectangular, or another suitable shape.

Figure 2:
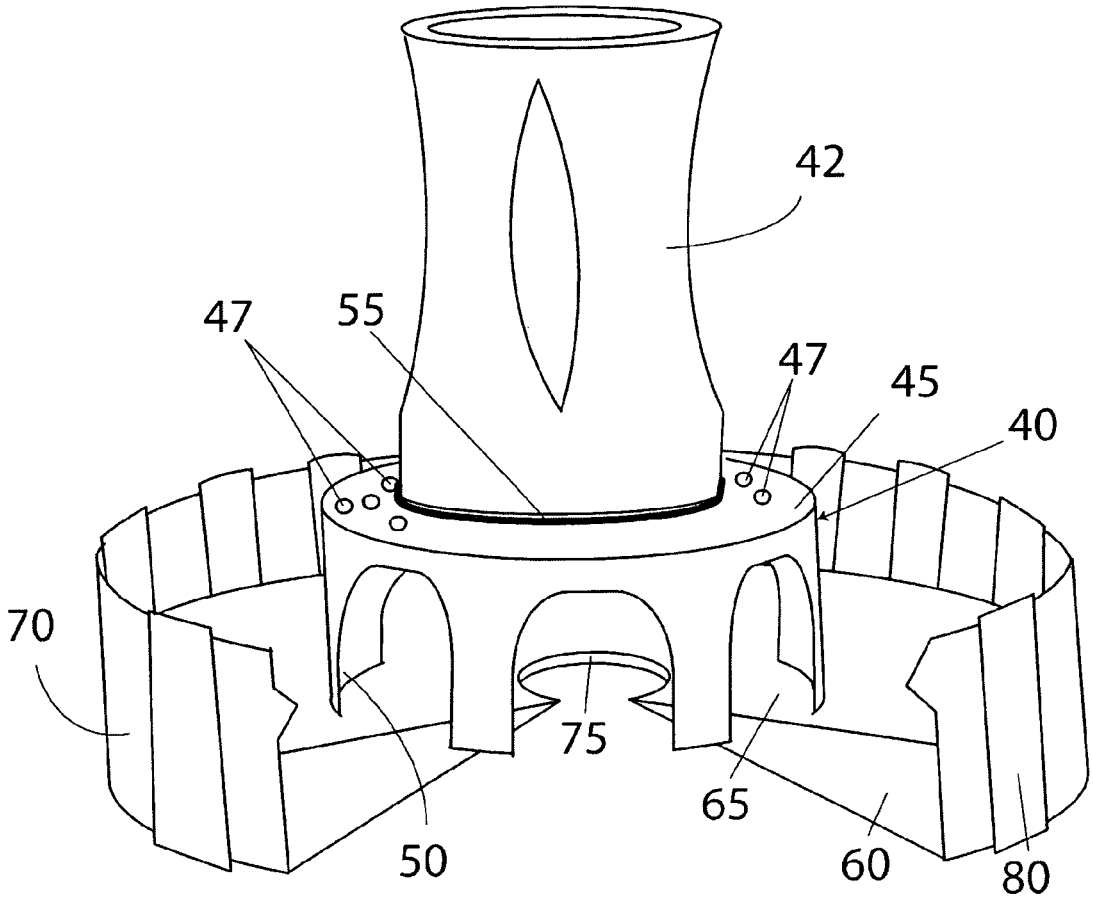
FIG. 2 is an exploded cross-sectional view of the present invention

Referring to FIG. 2, device (10) further includes second portion (40) having plate member (45) having a plurality of leg members (50). Lower end (30) is affixed to plate member (45) such that the circumference of bottom end (30) is totally closed. In other embodiments, as shown in FIG. 2, plate member (45) can include a plurality of small apertures (47) along the peripheral edge of plate member (45). Apertures (47) can further assist in fluid flow.

In some embodiments, a sealing member (55) (shown in FIG. 2), which circumferentially extends around plate member (45), can be used. Sealing member (55) can be a conventional gasket or another suitable sealing means.

The present invention further includes a reservoir (60). The reservoir has a base portion (65), drain hole (75), bottom side (76), and an outer wall (70). Each leg member (50) extends downward and is permanently mounted into base portion (65). Outer wall (70) extends upward from base portion (65) completely encompassing the leg members (50) and flushed to the height of plate member (45). Drain hole (75) is approximately located near the center of base portion (65). As shown in FIG. 2, base portion (65) slopes inwardly at an incline towards drain hole (75) to allow the fluid to better drain.

In some embodiments, reservoir (60) can further include hand gripping mechanism (80). Hand gripping mechanism (80) can be elevated ridges formed upon the outer wall (70) of reservoir (60). The elevated ridges allow a person to grip outer wall (70) and release device (10) from the plug in the tank.

Figure 3:
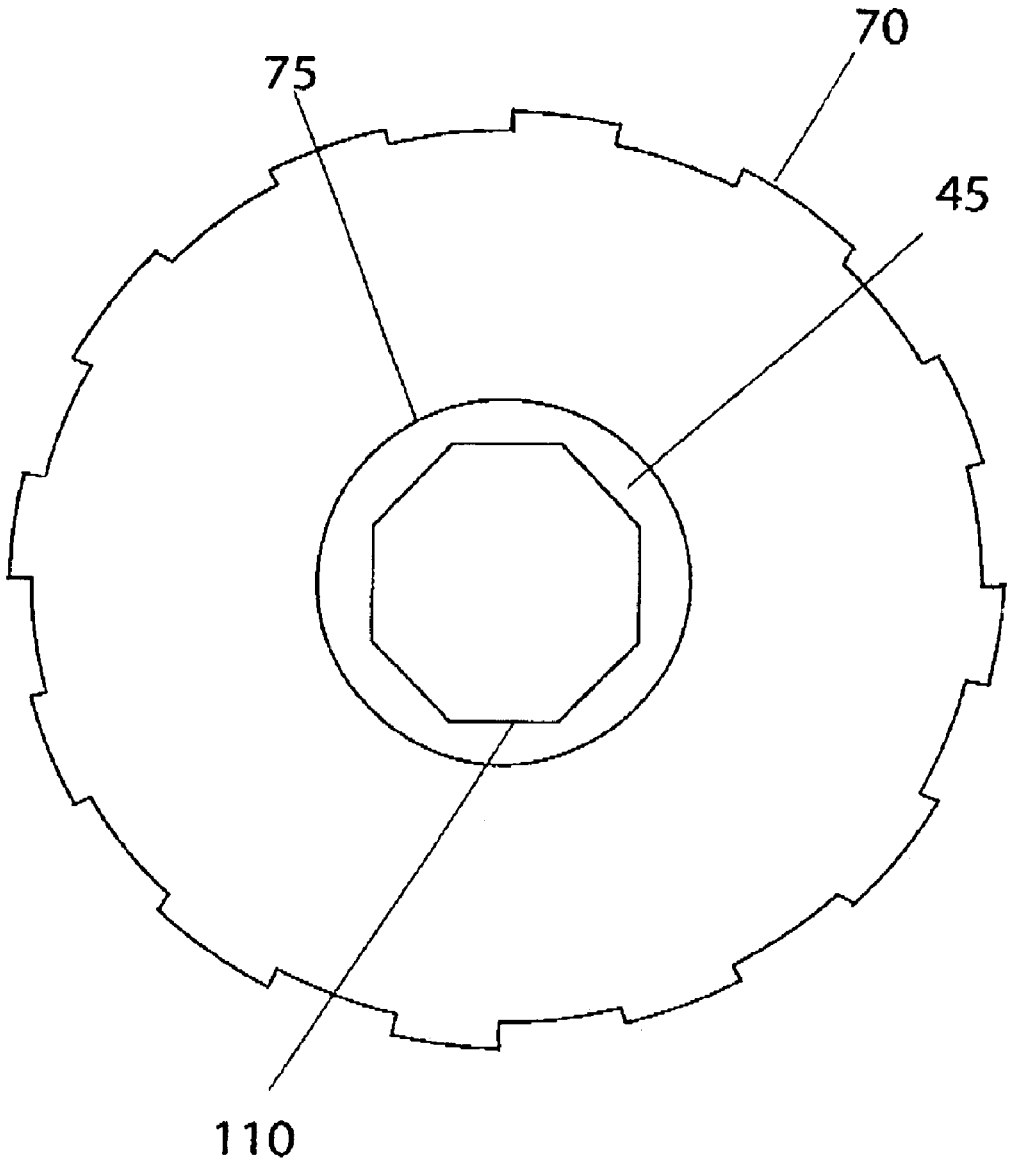
FIG. 3 is a bottom view of the present invention.

Referring FIG. 3 depicting the bottom view of device (10), bolt member (110) can be formed within under side of plate member (45) and configured to fit a conventional Allen wrench. As depicted, bolt member (110) has a polygonal shape and is positioned directly above drain hole (75). In use, the wrench is inserted through drain hole (75) and is inserted into bolt member (110).

Figure 4:
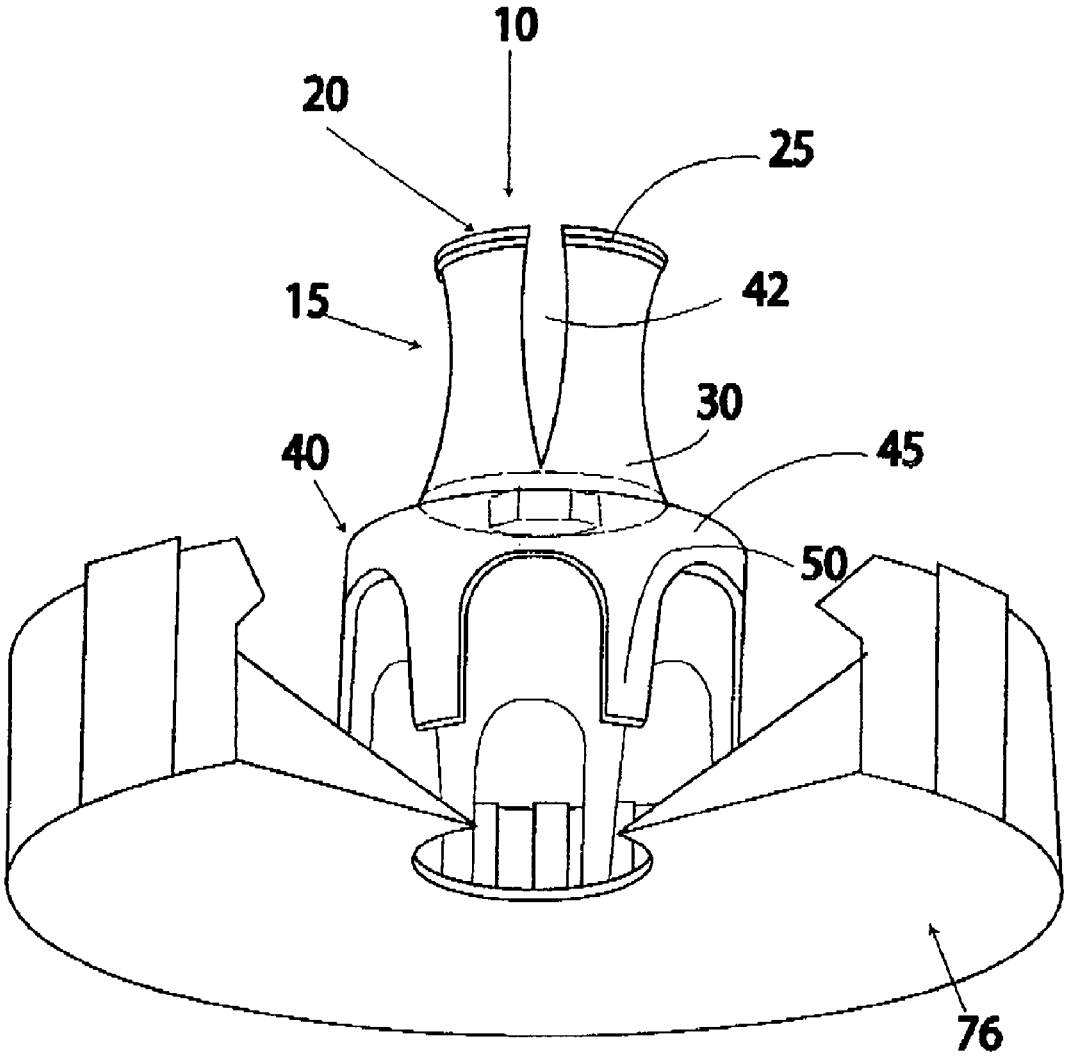
FIG. 4 and 4A is alternative embodiments of the present invention.
Figure 4A:
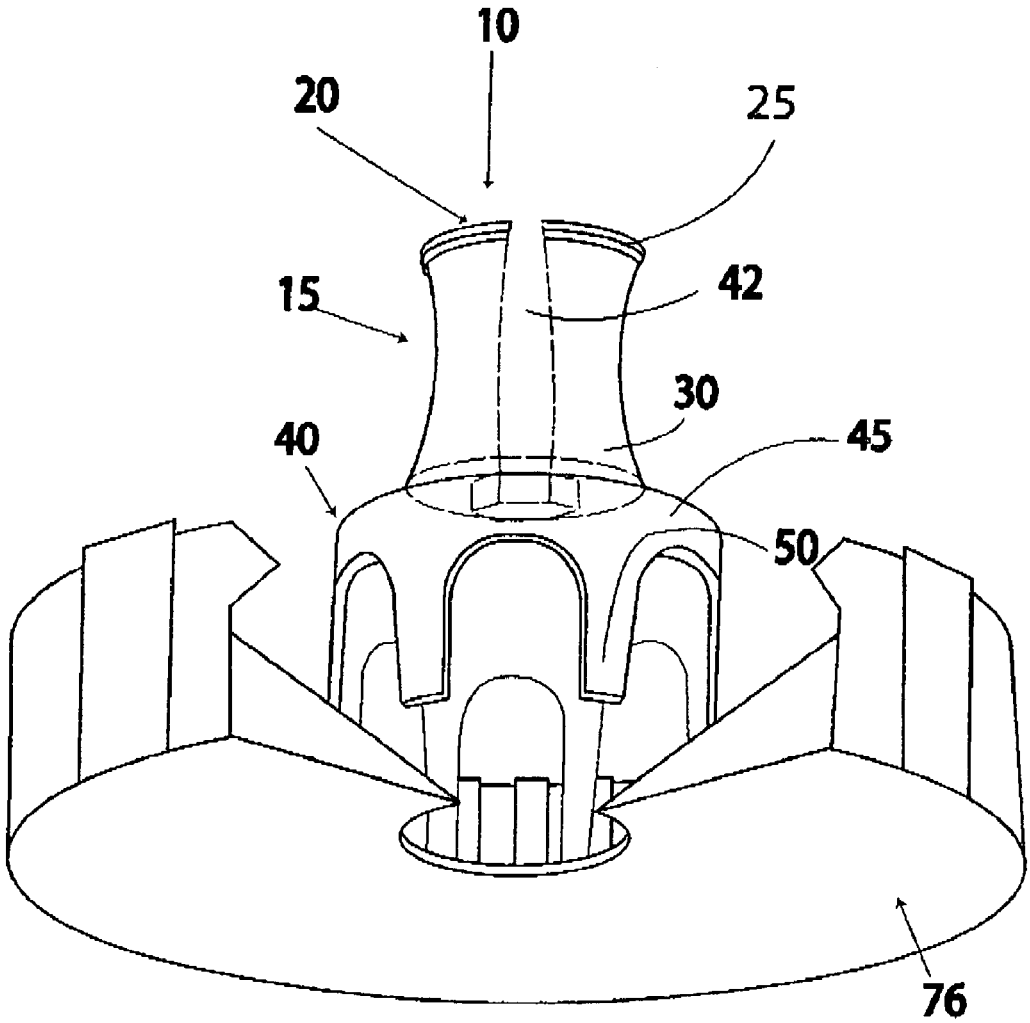

Referring to FIG. 4 and FIG. 4A, there are shown n alternative embodiments of device (10). Notch (42) can extend from lower end (30) to upper end (25) forming a gap within the far peripheral edge of bore (20). Bore (20) can still be inserted into the plug of the holding tank.

In operation, first portion (15) is threadedly engaged into the drain hole of a fluid holding tank (not shown in FIG. 1). Device (10) does not need to be totally disengaged from the holding tank. When a user wishes to drain the fluid, the first portion (15) is disengaged from the drain hole, by using the hand gripping mechanism (80) surrounding the outer wall (70) of the reservoir (60) or by using a wrench to disengage bolt member (110) as shown in FIG. 3. First portion (15) is disengaged to the desired level required to control the fluid flow through the notches (42). Each notch (42) acts as a valve to control the flow of fluid from the tank. The user disengages first portion (15) from the drain until the desired flow through the notches (42) is achieved.

Figure 2A:
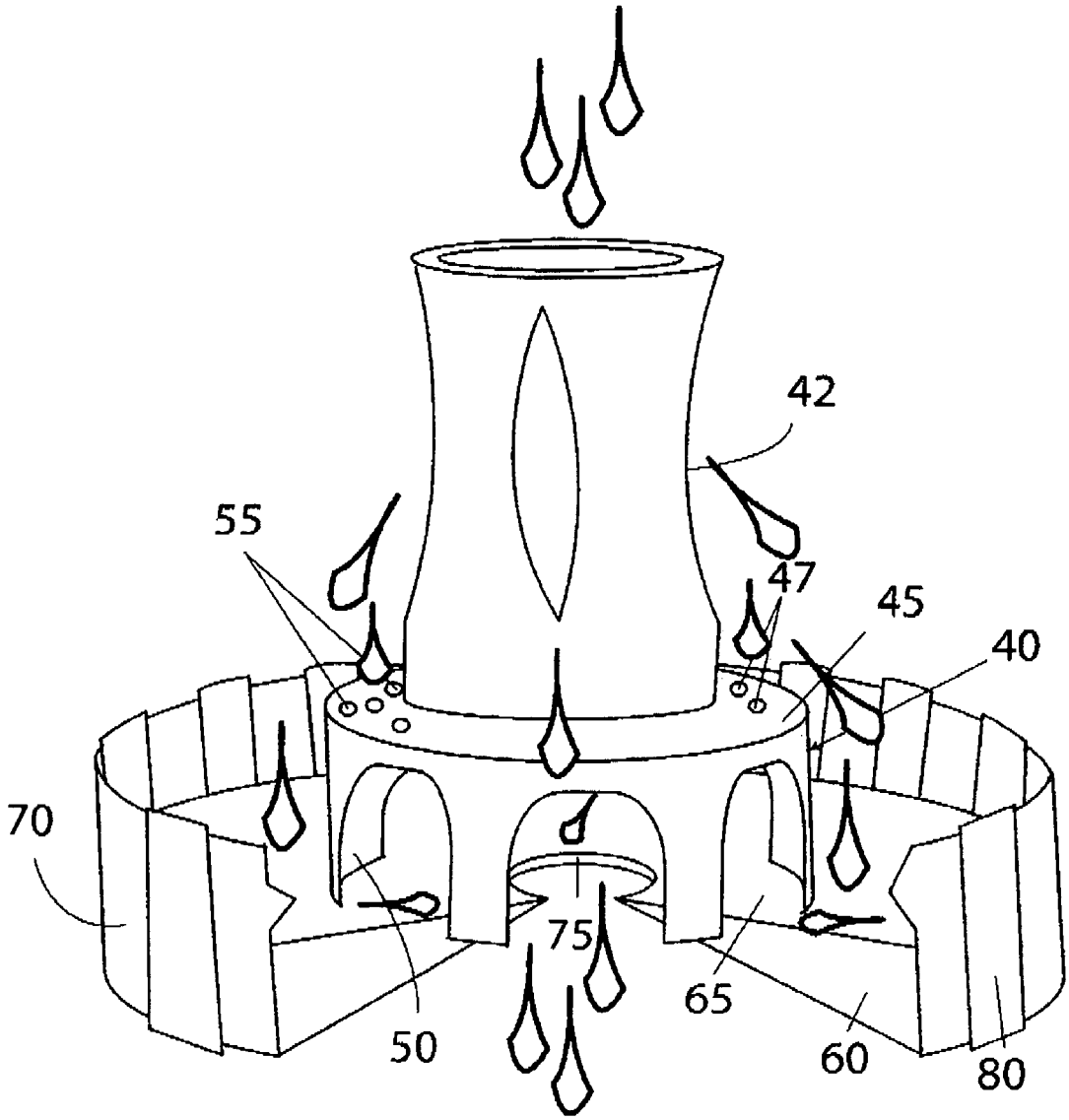
FIG. 2A is an exploded cross-sectional view of the present invention showing fluid flow

After the device (10) is disengaged to a desired level, fluid flows through bore (20) into drain hole (75). As illustrated in FIG. 2A, the fluid drops into bore (20), out of notch (40) into base portion (65) and finally through drain hole (75).

The length of the outer wall (70) of reservoir (60) is dimensioned to fit underneath the vehicle to allow for maximum ground clearance during the operation of a vehicle. The bottom side (72) of reservoir (60) is substantially flat underneath the vehicle to allow for maximum ground clearance during the operation of a vehicle. Also, if reservoir (60) is sheared off during the operation of the vehicle, device (10) will stay steal to prevent leakage. Then, device (10) can be removed from the holding tank with an Allan wrench.

What is claimed is:

1. An apparatus for draining fluid from a holding tank, the apparatus comprising:

a first portion having an axial bore extending therethrough, the axial bore being defined by an upper end and a lower end, an-outer wall surrounding the axial bore extending from the lower end to the upper end, the upper end adapted to engage an existing drain hole of the holding tank such that fluid communication is established between the axial bore and the holding tank;

at least one notch of a predetermined size and configuration to achieve a desired flow, the at least one notch forming an opening within the outer-wall of the bore;

a second portion having a plate member with a plurality of leg members, the lower end of the bore being permanently affixed to the plate member;

and a reservoir surrounding the leg members, the reservoir having a base portion with an external wall extending upward therefrom to surround the leg members, each leg member extending downward into the base portion and being permanently affixed thereto; and the base portion having an aperture for providing an outlet for drainage of the fluid from the holding tank.

2. The apparatus of claim 1 wherein the at least one notch extends upward to the upper end forming a gap therein.

3. The apparatus of claim 1 wherein the external wall of the reservoir has a hand gripping mechanism.

4. The apparatus of claim 3 wherein the hand gripping mechanism further comprises a plurality of elevated ridges formed upon the external wall of the reservoir.

5. The device of claim 1 further comprising: the plate member having an underside; a groove within the underside of the plate member, the groove dimensioned to fit a wrench mechanism; and the groove positioned above the aperture of the base portion of the reservoir such that the wrench mechanism can be inserted through the aperture in the reservoir into the groove.

6. The device of claim 1 wherein the plate member further comprises a plurality of small apertures along the peripheral edge of the plate member.

7. The device of claim 1 further comprising: a sealing means dimensioned to accommodate the plate member; and the sealing means extending circumferentially around the plate member.

8. The device of claim 1 wherein the base portion further comprises a thickness that slopes inwardly at an incline from the outer peripheral edges of the base portion towards the aperture.

9. The device of claim 1 wherein the at least one notch extends from the upper end to the lower end of the first portion.

10. The device of claim 1 wherein the external wall of the reservoir has a length dimensioned to allow for maximum ground clearance during the operation of a vehicle.

11. The device of claim 10 the reservoir further comprises a substantially flat bottom side to allow for maximum ground clearance during the operation of a vehicle.

* * * * *